US010104757B2

(12) United States Patent
Arnold

(10) Patent No.: US 10,104,757 B2
(45) Date of Patent: Oct. 16, 2018

(54) PARTICLE ACCELERATOR FOR GENERATING A BUNCHED PARTICLE BEAM

(71) Applicant: AMPAS GMBH, Großerlach (DE)

(72) Inventor: Wolfgang Arnold, Großerlach (DE)

(73) Assignee: AMPAS GMBH, Großerlach (DE)

( * ) Notice: Subject to any disclaimer, the term of this patent is extended or adjusted under 35 U.S.C. 154(b) by 0 days.

(21) Appl. No.: 15/528,761

(22) PCT Filed: Dec. 9, 2015

(86) PCT No.: PCT/EP2015/079098
§ 371 (c)(1),
(2) Date: May 22, 2017

(87) PCT Pub. No.: WO2016/091940
PCT Pub. Date: Jun. 16, 2016

(65) Prior Publication Data

US 2017/0332472 A1 Nov. 16, 2017

(30) Foreign Application Priority Data

Dec. 9, 2014 (DE) ..... 10 2014 118 224

(51) Int. Cl.
*H05H 7/02* (2006.01)
*H05H 9/04* (2006.01)

(52) U.S. Cl.
CPC ..... *H05H 7/02* (2013.01); *H05H 9/048* (2013.01); *H05H 2007/025* (2013.01)

(58) Field of Classification Search
None
See application file for complete search history.

(56) References Cited

U.S. PATENT DOCUMENTS 2,992,357 A 9/1958 Nygard
3,383,590 A * 5/1968 Koontz ..... H05H 7/18
315/5.43

(Continued)

FOREIGN PATENT DOCUMENTS

DE 1200972 B 7/1963
DE 2519845 A1 5/1975

(Continued)

OTHER PUBLICATIONS

Tzuang et al "Non-reciprocal phase shift induced by an effective magnetic flux for light" Nature Photonics Jun. 23, 2014. Macmillan publishers.*

(Continued)

*Primary Examiner* — Douglas W Owens
*Assistant Examiner* — Srinivas Sathiraju
(74) *Attorney, Agent, or Firm* — WRB-IP LLP

(57) ABSTRACT

A particle accelerator for creation of a bunched particle beam and a method for the operation of such a particle accelerator are provided, wherein the particle accelerator includes an HF source and a directional coupler for splitting HF power of the HF source of an HF side into at least a first and a second HF power coupler of a cavity side for coupling in the HF power into at least one accelerator cavity. A non-reciprocal phase shifter is inserted on the cavity side between the directional coupler and the second HF power coupler, and an HF load is connected on the HF side to the directional coupler, where the non-reciprocal phase shifter is configured to pass a reflected HF wave of the second HF power coupler with phase delay in the direction of the directional coupler in such a way that a destructive interference of the reflected HF waves of the first and second power couplers occurs in the directional coupler in the direction of the HF source on the HF side.

11 Claims, 5 Drawing Sheets

(56) References Cited

Figure 1:
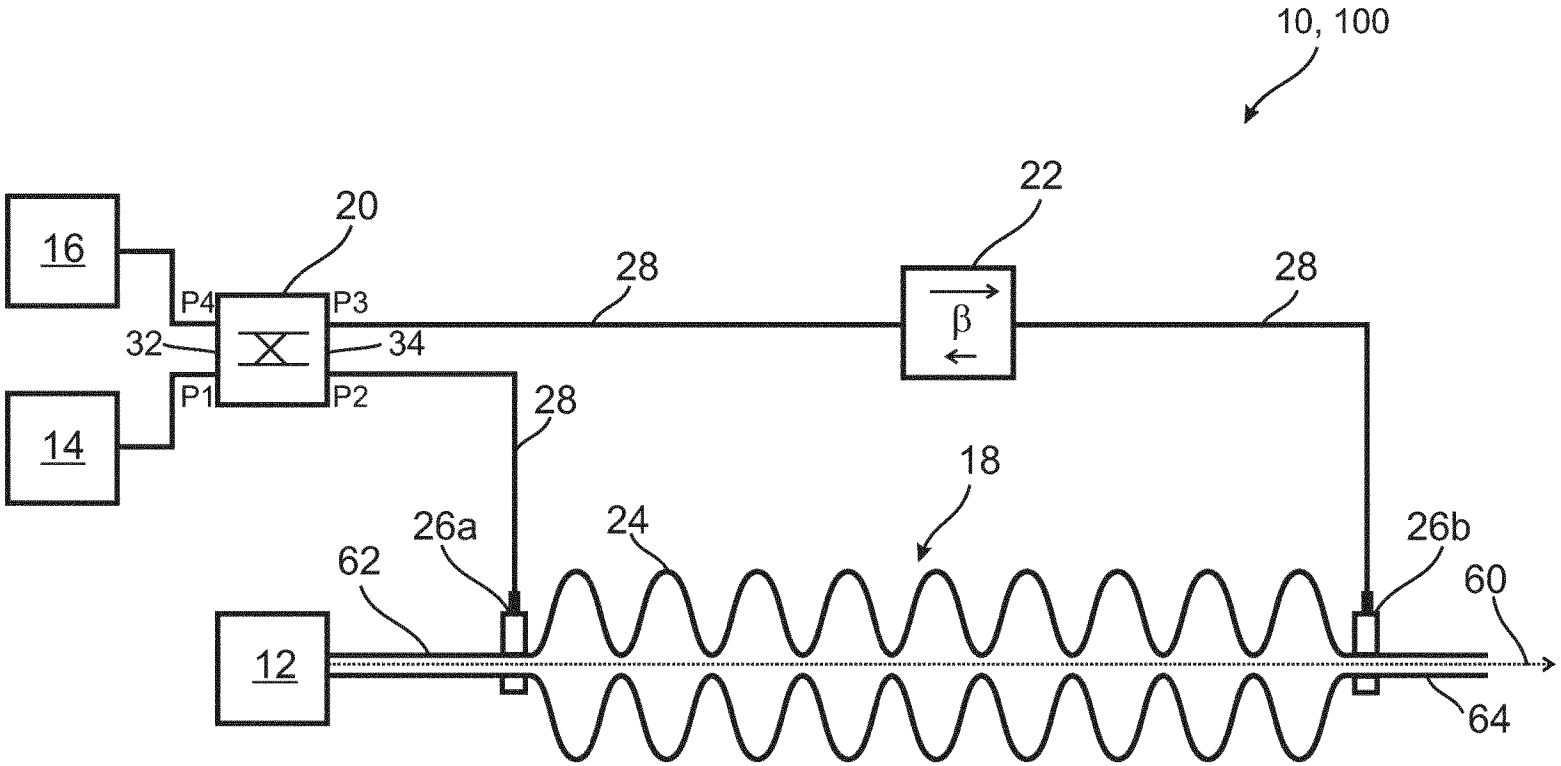

U.S. PATENT DOCUMENTS 4,004,181 A * 1/1977 Kervizic ..... H01J 23/20 315/5.41
5,523,659 A * 6/1996 Swenson ..... H05H 7/22 315/500
6,777,893 B1 * 8/2004 Swenson ..... H05H 7/22 315/505
7,098,615 B2 * 8/2006 Swenson ..... H05H 7/22 315/505
7,400,094 B2 * 7/2008 Meddaugh ..... H05H 9/04 315/111.61
7,756,170 B2 * 7/2010 Almoric ..... G02F 1/377 372/21
7,786,823 B2 * 8/2010 Heisen ..... H03H 7/48 315/505
8,736,198 B2 * 5/2014 Haruna ..... H05H 13/04 250/251
9,053,833 B2 * 6/2015 Plettner ..... G21K 5/04
2004/0212331 A1 * 10/2004 Swenson ..... H05H 7/22 315/506
2007/0046401 A1 * 3/2007 Meddaugh ..... H05G 2/00 333/227
2007/0164237 A1 7/2007 Bernhardt
2007/0296530 A1 12/2007 Heisen et al.
2008/0068112 A1 * 3/2008 Yu ..... H01P 1/16 333/228
2009/0022188 A1 * 1/2009 Almoric ..... G02F 1/377 372/22
2012/0326636 A1 12/2012 Eaton et al.
2013/0113503 A1 * 5/2013 Ruf ..... G01T 1/29 324/654
2014/0239805 A1 * 8/2014 Plettner ..... G21K 5/04 315/9

FOREIGN PATENT DOCUMENTS

DE 96934598 T2 2/1996
DE 102011076262 A1 5/2011
DE 202013105829 U1 12/2013
WO 2008022188 A1 8/2007
WO WO 2008022188 A1 * 2/2008 ..... H05H 7/02

OTHER PUBLICATIONS

German Official Action (dated May 10, 2015) for corresponding German App. 10 2014 118 224.3.

* cited by examiner

PARTICLE ACCELERATOR FOR GENERATING A BUNCHED PARTICLE BEAM

BACKGROUND AND SUMMARY

The invention relates to a particle accelerator, in particular to an electron accelerator, for creation of a bunched particle beam. Such particle accelerators are employed in particular in medical technology to generate a beam of charged particles. Further fields of application of a particle accelerator of this type include, for example, high-energy physics, in which experimental investigations of material nuclei are carried out, and materials processing by means of ionised radiation.

Particle accelerators accelerate electrically charged particles that are emitted from a particle source, in particular from an electron or proton source, with the aid of electromagnetic fields. Particles with a high kinetic energy, which can be used for a variety of purposes, are obtained by this acceleration.

For medicine in particular, these high-energy-charged particles are of particular interest, since they can be used for radiation therapy. High-energy particles are used in imaging examination methods or for therapy, in particular for cancer therapy, in order to create in turn high-energy electromagnetic radiation. Kinetic energies of 1 MeV or more are required here, with the charged particles being typically accelerated by a series of cavity resonators which work according to the principle of a standing-wave accelerator or of a travelling-wave accelerator, and are grouped into particle packets known as bunches. An electromagnetic wave is set into resonance in the individual cavities of the cavity accelerator, and by exploiting the resonance frequency a high electrical field strength of up to several millions of volts per meter are created with relatively little technical effort, by means of which the electromagnetic particles are accelerated and can be concentrated into particle packets known as bunches. Acceleration energy is transferred to the particles by correctly phased correlation of the field strength of the electromagnetic field oscillating in the cavities and of the electromagnetic particles flying through them. The central components of such a particle accelerator are a particle source and an arrangement of several cavities that are mechanically connected to one another, in which a standing or travelling wave is created in order to accelerate and bunch the particles.

When coupling the electromagnetic wave into the cavities of the resonator structure, the problem arises that a part of the electromagnetic wave is reflected, thus reducing the efficiency of the HF energy supply, which is coupled in for acceleration. In addition, unwelcome higher modes are excited in the resonator cavity, in particular by the particles themselves that are flying through, which prevent an optimum acceleration of following particles. The efficiency of the acceleration mechanism is further reduced by this. Finally, only a small quantity of electromagnetic energy can be supplied into the cavity resonators, so that either a large number of cavities have to be provided, or high power losses occur.

A particle accelerator is described in DE 20 2013 105 829 U1, whose high-frequency energy of an HF source is distributed by a current divider to two HF power couplers, where HF energy is coupled via a first branch into a first section of an accelerator tube by means of a first HF power coupler and a second part of an HF energy is supplied via a reciprocal phase shifter into a second section via a second HF power coupler of an accelerator cavity. The total HF power in the two accelerator tube segments can be controlled by means of the phase shifter. This document therefore addresses the coordination of the phases at both coupling points in order to provide a controllable HF power coupling for particle acceleration. The problem of reflected HE power at the HF power coupler, which results in strain on the HF source, is not discussed.

In addition, a particle accelerator is disclosed by DE 10 2011 076 262, in which electromagnetic energy of an HF source is split via a circulator into two partial energies, a first part being supplied into a first cavity section and a second part being coupled via a phase shifter into a second cavity section of a waveguide structure. Reflected energy from the second or first cavity section can be diverted via a respective HF load. As a result, a separate HF load is required at each coupling point.

A particle accelerator structure is also disclosed by DE 696 34 598 T2, comprising two coupling-in points for HF energy into an accelerator structure. The circuit variant described therein relates to the optimised adjustment of HF powers into two separate accelerator guide sections. Symmetrical hybrids, i.e. directional couplers, are arranged for this purpose, where a synchronisation of the amplitude and phase between the two coupling-in points can be achieved by adjustable and variable short-circuit devices, which can be motor-driven, and by a controller. Two coupling-in points can be operated using highly complex circuitry with scalability for yet more coupling-in points not being offered. Variable short-circuits are provided for coordinating the power of the second accelerator section, necessitating a large number of expensive HF components, and a complex controller is provided.

US 2012/0 326 636 A1 presents a particle accelerator device in which HF power is coupled at one point into an accelerator cavity. An AFC (Automatic Frequency Controller) is provided to regulate the HF power, and serves to control the HF source. The AFC can comprise an adjustable phase shifter, and serves to control the HF source, where the amplitude and phase of reflected and transmitted power can be determined by the AFC. The particle accelerator described provides only one HF coupling-in point, and does not address any problems associated with the coupling in of HF power at multiple points.

Further accelerator structures of a similar type are known from DE 25 19 845 A1, US 2007/0164 237 A1 and DE 1 200 972 B.

The accelerator structures known from the prior art do not permit any scalability in the number of coupling-in points, and do not provide any solution for relieving an HF source by destructive annihilation of backward-travelling wave components from the HF power coupler.

It is the desirable to propose a particle accelerator exhibiting an improved efficiency, so that a given resonator structure can create higher accelerator energies and permits an efficient excitation of the relevant basic frequency for accelerating the particles, where higher modes are attenuated, or an optimum efficiency of the coupling of the electromagnetic energy into the resonator cavity is enabled.

A particle accelerator is proposed in accordance with an aspect of the invention, in particular an electron accelerator that serves to create a bunched particle beam. The particle accelerator comprises an HF source and a directional coupler for splitting an HF power from the HF source of an HF side into at least a first and a second HF power coupler of a cavity side for coupling the HF power into at least one accelerator cavity. It is proposed that a non-reciprocal phase shifter is inserted on the cavity side between the directional coupler and the second HF power coupler, and that an HF load is connected to the directional coupler on the HF side. The non-reciprocal phase shifter is designed such that a reflected HF wave of the second HF power coupler passes through in the direction of the directional coupler with a phase delay such that a destructive interference results between the reflected HF waves of the first and second power couplers in the directional coupler in the direction of the HF source on the HF side.

In other words, a particle accelerator is proposed that comprises at least one accelerator cavity with a plurality of accelerator resonator elements. To supply HF power at two different coupling-in points of the cavity or at two sequential cavity sections, HF power of an HF source is split by means of an HF power coupler into two HF strands. In the first HF strand, HF power is supplied by a first power coupler into a first cavity of the accelerator structure. In the second HF power strand, a non-reciprocal phase shifter is active, by which HF power can be coupled, with phase delay, via a second power coupler into a second HF cavity region of the resonator structure. HF power travelling back in the direction of the HF source is reflected in both the power couplers. The reflected HF wave of the second power coupler is phase-delayed by the non-reciprocal phase shifter such that it is superimposed in the directional coupler on the reflected HF power of the first power coupler such that destructive interference results, so that the HF source is not subjected to reflected HF power. The excess reflected HF energy can be diverted to a connected HF load which also is connected to the directional coupler on the HF side. The result of this is that the HF source works at an ideal efficiency and is not subjected to reflected HF power. It is, accordingly, terminated with the correct impedance, and can guide the entire HF power into the resonator cavity, since no reflected HF power flows backwards. The non-reciprocal phase shifter permits a phase offset for the HF power flowing into the second power coupler in such a way that it can be optimally coupled, with the correct phase, into the second coupling-in region of the resonator cavity. A reflected HF power is delayed in phase in such a way that it is practically extinguished with the reflected HF power of the first power coupler, and that the reflected HF power that remains is diverted into the HF load. This results in an optimum efficiency, so that a high acceleration performance can be achieved even with a simply designed resonator cavity. Higher energies can be created with a more economical and smaller resonator structure.

In an advantageous development of the invention, the directional coupler can be a 4-port directional coupler, in particular a 3 dB directional coupler. In a 3 dB directional coupler, which is also known as an HF power splitter, there is a connection in the main branch between the terminals P1 to P2, and P3 to P4. In addition, an incoming wave that is reflected at port P3 is coupled to the output P4, and in the same way an incoming wave at port P1 is also output to port P3; these coupling branches are therefore represented with crossed arrows in the centre. A directional coupler of this type is also referred to as a forward coupler with four ports. The directional coupler permits reflected power to be transported to the HF load, where the HF source can discharge energy into the accelerator structure with an optimum efficiency.

In an advantageous development of the invention, the non-reciprocal phase shifter can be configured to pass through an adjustably changeable phase delay of the reflected HF wave. Due to the possibility of a changeable phase delay of the non-reciprocal phase shifter, it is possible, for example in the event of a thermal expansion or of a detuning of the resonator cavity, to adjust the phase delay, and to provide a universal building kit for electron accelerators that can be adapted to specific resonator cavities. It is furthermore conceivable that the phase shifter is electronically controllable and that it can set varying phase shifts in the forward and/or reverse branch, for example when an adjusting signal is given. The HF power coupled in via the second power coupler can thus be adjusted, and the energy of the electron beam thereby regulated. The power of the electron beam can also be regulated by the adjustment of the phase shift of the reflected power in both regions. A universally applicable coupling-in network for coupling HF power into a large number of resonator cavities is thus provided, while on the other hand the possibility is also offered of selective control of the coupled-in HF power, and hence of the power of the particle beam.

At least one second non-reciprocal phase shifter can be advantageously provided, inserted on the cavity side between the directional coupler and an HF power coupler, in particular the first power coupler. In this further development, it is proposed that a second non-reciprocal phase shifter can be activated in a further HF branch, in particular in the HF branch of the first power coupler or in an HF branch of a further power coupler. This results in the possibility of reducing the power in yet further regions, as well as of minimising reflected HF power. By cascading several coupling-in branches with several non-reciprocal phase shifters, a high HF power can be supplied into the resonator cavity with an optimised efficiency. This results in far-reaching, possibilities for controlling the HF power, and hence the particle beam.

It is furthermore conceivable to comprise at least a third HF power coupler, which is connected via an at least second directional coupler to the cavity side of the first directional coupler, and which couples in HF power to the accelerator cavity at a further coupling-in point. In this structure, the possibility emerges of coupling in HF power at least at a third or at further points of the resonator structure. Thanks to a modular structure, whereby several coupling-in branches can be formed, in each of which not-reciprocal phase shifters are provided, the reflected power can be minimised, hence improving the efficiency of the HF source, and the coupled-in power can be controlled. This results in the possibility of providing a particle accelerator with a high power spectrum that operates with optimum efficiency. Advantageously, two, four, or a number 2n of coupling-in points are provided, in order to supply the same quantity of HF energy at each coupling-in point. Each directional coupler splits 50% of the HF energy to the two cavity-side output branches, so that 2, 4, 8 or 2n coupling-in points can each be supplied with the same 50%, 25%, 12.5% or 100%/2n HF energy.

In a development of the development discussed above in accordance with the invention, a second HF load can be connected to an HF side of the second directional coupler. As a result of the fact that with a modular structure of at least three or more coupling-in points, a second or more directional couplers are provided, and a further HF load can be connected at least at the second or more directional couplers, reflected HF powers can be absorbed in different HF loads, so that the strain on the overall network of the first HF load is reduced. As a result of this, the possibility emerges, in particular in the case of high-energy applications, of achieving a high level of power and of providing an energy-rich particle beam.

On the basis of the aforementioned further development of a particle accelerator with modular structure having at least three coupling-in points, it can furthermore be advantageous if a further non-reciprocal phase shifter can be inserted between the first directional coupler and the second directional coupler. With a modular structure, therefore, phase shifters can be inserted between the individual directional couplers, so that each phase shifter is designed to delay the phase of a wave reflected in this branch from the several coupling-in points in such a way that it can be superimposed on the respective previous reflected wave with the correct phase. This permits a destructive interference to be achieved in each modular construction stage, so that the entire reflected HF power does not have to be passed back to the first directional coupler, but rather can already be degraded in further modular stages.

A further advantageous exemplary embodiment can furthermore comprise an HF switching element that can disconnect the second power coupler from the directional coupler. The second HF switching element can be designed as an electronic or mechanical switching element, and can switch the HF supply in the branch to the second power coupler on or off, so that the coupled-in HF power can be increased or reduced. This permits a switchable increase or decrease in the HF acceleration energy, in order to permit further control of the energy of the particle beam. It is of course understood that with a modular construction of more than 2 supply points, HF switching elements can be provided in each further HF supply branch.

In a subsidiary aspect, a method is proposed for the operation of a particle accelerator as described above, in which the phase delay of the non-reciprocal phase shifter is adjusted such that a reflected HF wave of the second power coupler is superimposed on a reflected HF wave of the first power coupler in the directional coupler in such a way that a destructive interference of the returning HF waves on the HF side results in the direction of the HF source. In accordance with the invention, a tuning specification is given on how the phase delay of the non-reciprocal phase shifter of the returning wave from the power coupler in the direction of the HF source is to be adjusted in order to achieve a destructive interference with the reflected HF wave of the first power coupler, so that no strain on the HF source results in the directional coupler, and the excess reflected power can be diverted into the HF load. In the case of adjustable non-reciprocal phase shifters in particular, this creates the possibility of being able to adapt a universal HF power electronics twit to any cavity structures in order to ensure an optimum operation of a particle accelerator.

In an advantageous development of the aforementioned method, the delay of the non-reciprocal phase shifter can be controllable. The control, in particular the electronic control, of the phase shifter enables the power of the HF coupling-in to be adjusted over a wide range and the particle beam energy to be made controllable. The adaptation of the HF supply network to any resonator cavities is also enabled.

On the basis of the previous further development of the method the controllable phase delay of the non-reciprocal phase shifter can regulate an HF power input into the accelerator cavity. Two effects are enabled in this way, namely the regulation of the total HF power that can be coupled into the resonator cavity and the elimination of reflected waves in the direction of the HF source, so that an optimum efficiency of the HF side of the particle accelerator can be achieved, and controllability of the particle beam energy is made possible.

BRIEF DESCRIPTION OF THF DRAWINGS

Further advantages emerge from the description of the drawings below. Exemplary embodiments of the invention are illustrated in the drawings. The drawing, description and the claims contain numerous features in combination. The person skilled in the art will expediently also consider the features individually and combine them into useful further combinations.

Figure 2:
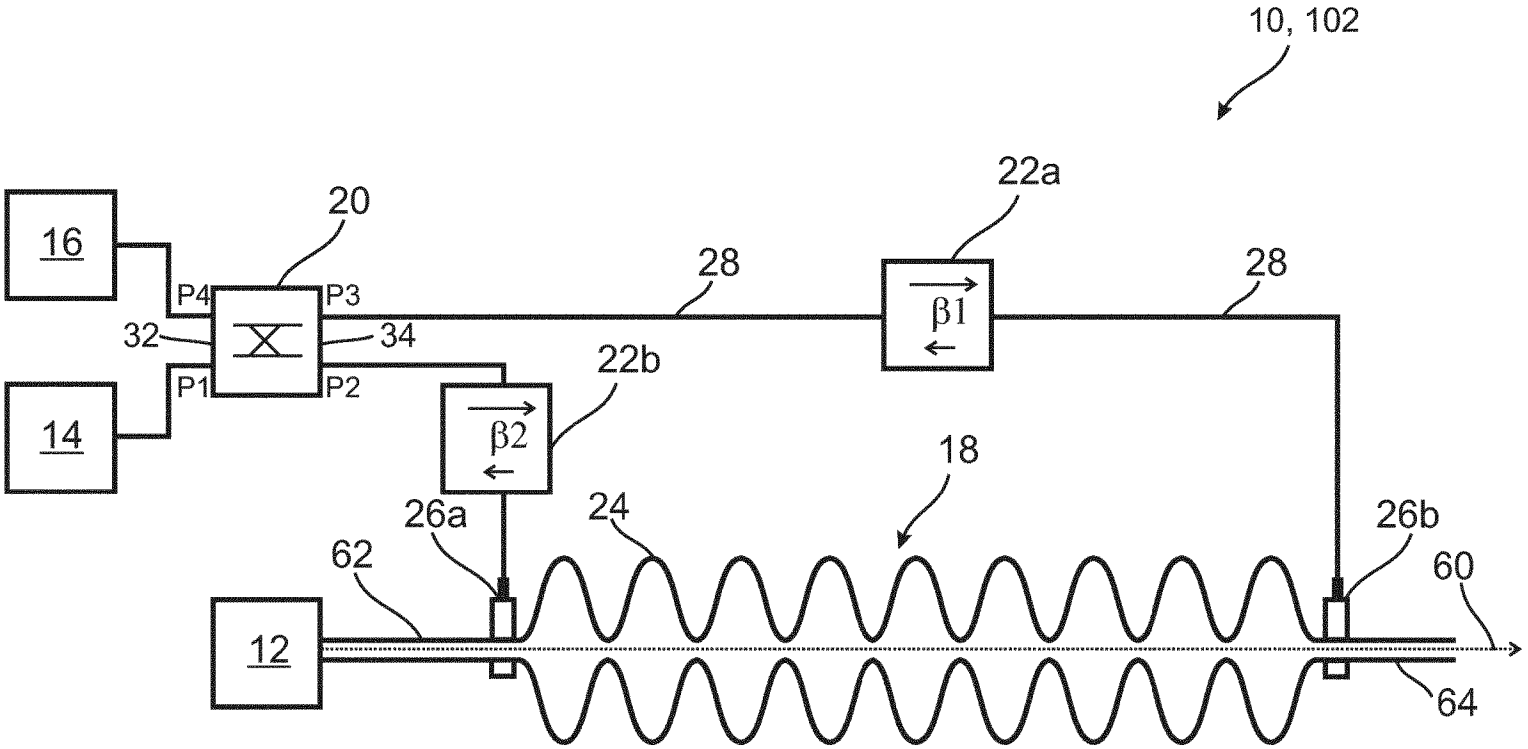
Figure 3:
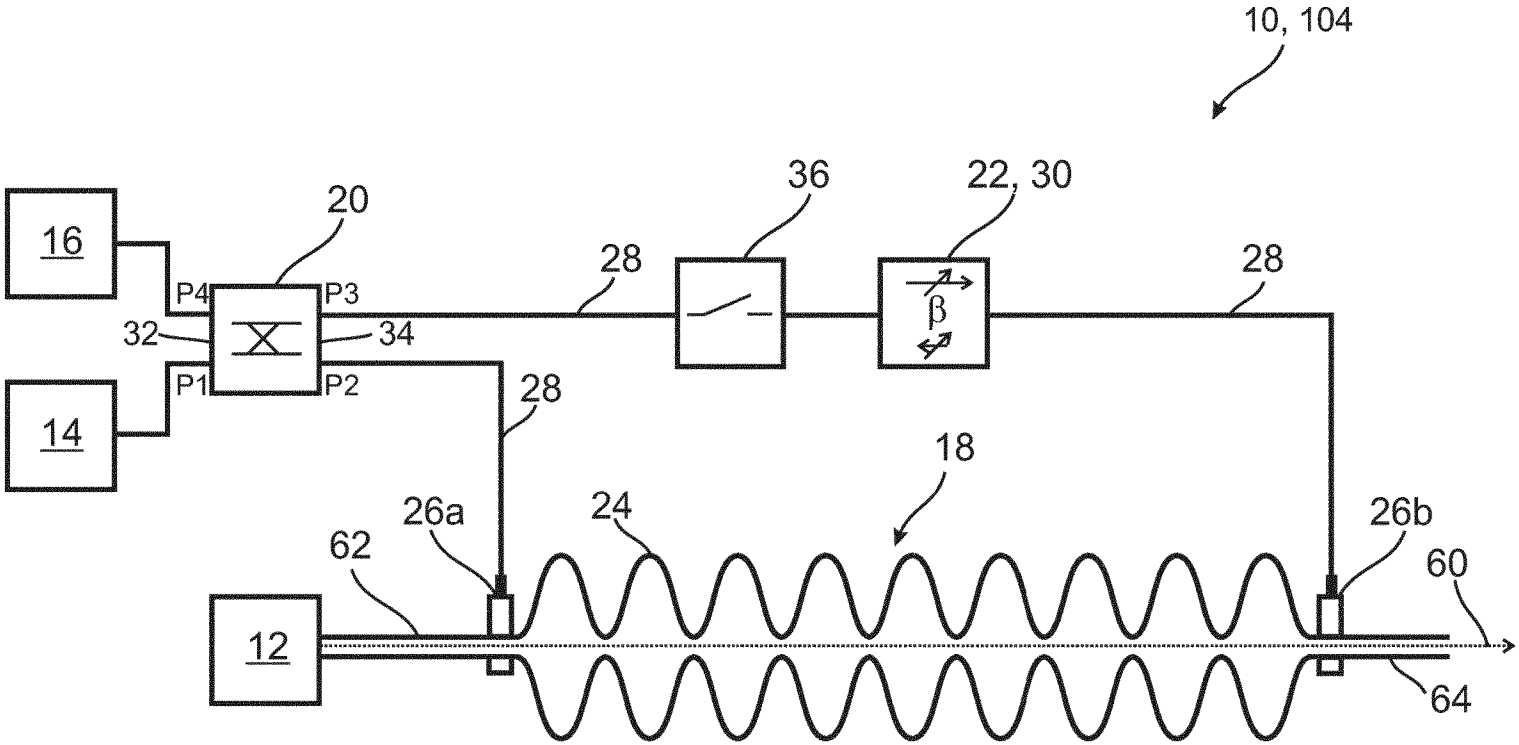
Figure 4:
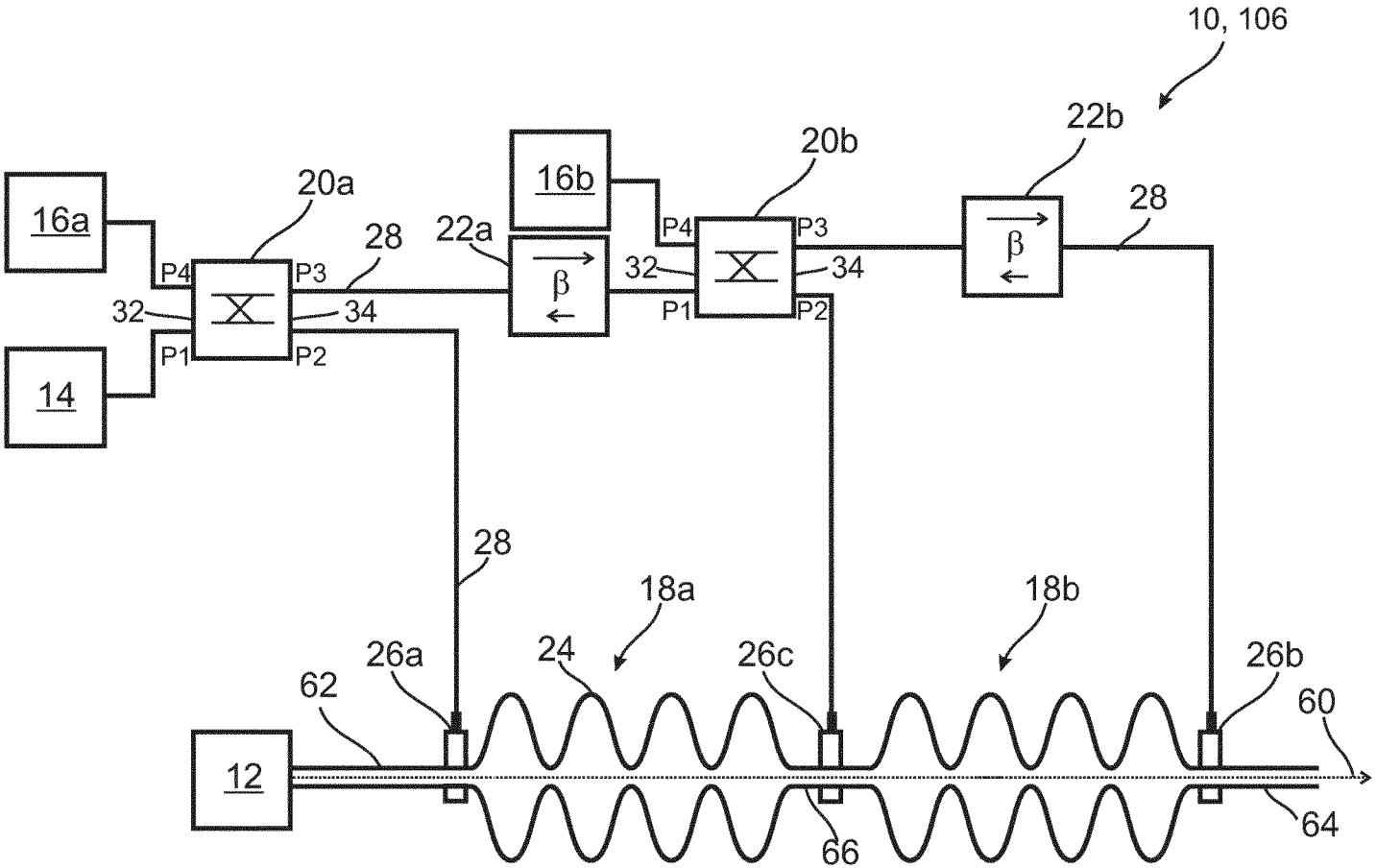
Figure 5:
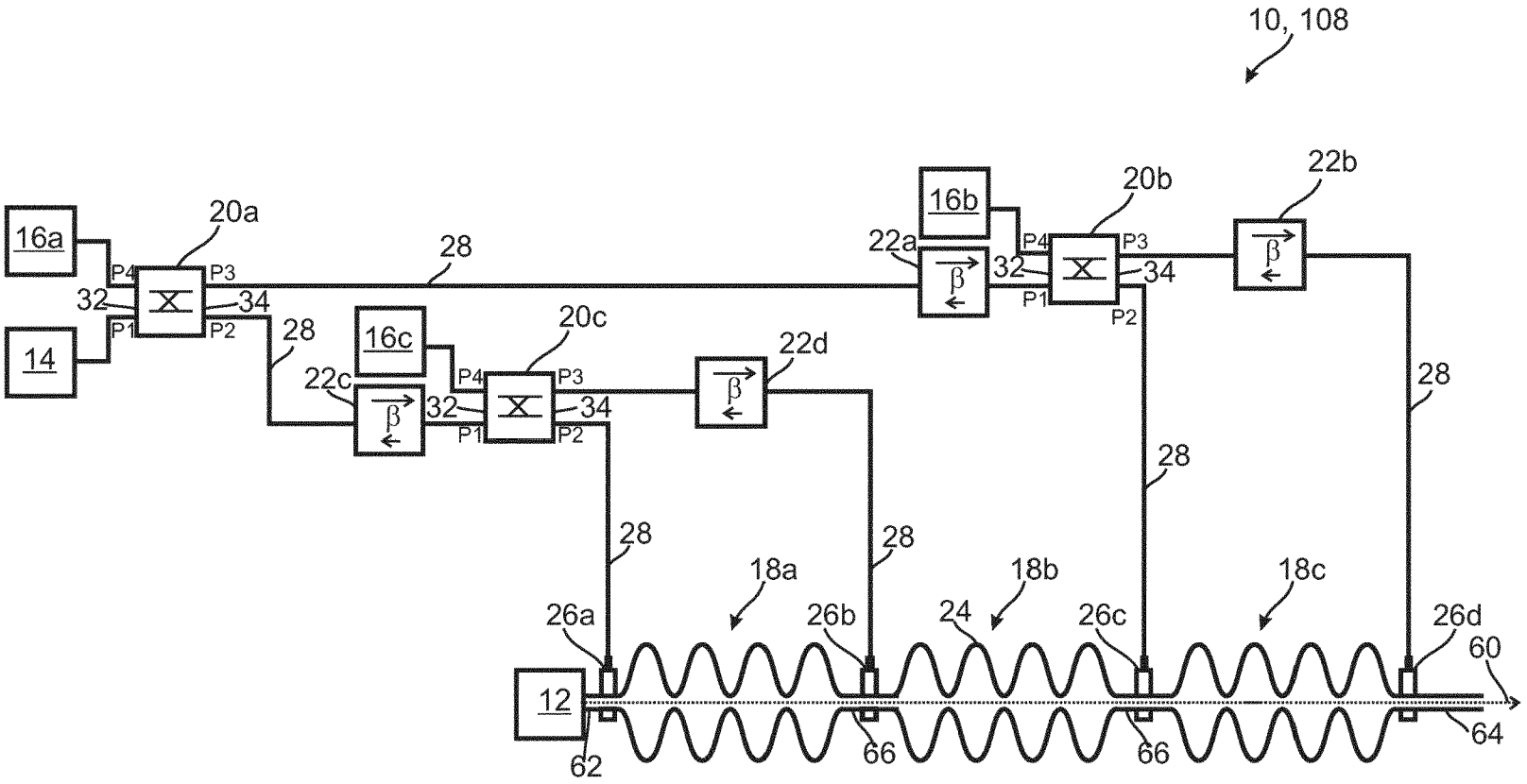

The drawing shows in:

FIG. 1 a schematic illustration of a first embodiment of the invention,

FIG. 2 schematically a second exemplary embodiment of the invention,

FIG. 3 a further schematically illustrated exemplary embodiment of the invention, FIG. 4 a further schematically illustrated embodiment of the invention with three coupling-in points, FIG. 5 a further schematically illustrated, embodiment of the invention with four coupling-in points.

The same reference numerals have been used to identify elements that are identical or similar in the figures.

DETAILED DESCRIPTION

FIG. 1 illustrates a first embodiment 100 of a particle accelerator 10. The particle accelerator 100 comprises a particle source 12, for example an electron source with a heatable cathode, which is heated and emits electrons. The electrons emitted are focused by a focusing segment 62, for example a solenoid magnet, not illustrated, and passed to a resonator cavity 18. The accelerator cavity 18 comprises a large number of mechanically connected individual resonator cavities 24, into which HF power can be coupled, where one mode, usually the basic mode of the HF power, creates electrical fields in the direction of acceleration with the correct phase for the flight speed of the particles, in order to transmit a respective acceleration pulse to the particles. Two power couplers 26*a* and 26*b* are arranged at the front and rear ends of the accelerator cavity in order to couple the HF power into the accelerator cavity 18. The power couplers serve to couple HF power into the individual resonator cavities 24 in order to develop the acceleration modes, and in some cases to couple out higher modes that are excited by the particles, and are unwelcome since they hinder an optimum acceleration. Accordingly, a fraction of the HF power that is supplied via HF waveguides 28, for example hollow waveguides, microstrip or coaxial cables, to the power couplers 26 is reflected again and passed back in the direction of the HF source 14. The HF source 14, for example a magnetron, creates high-frequency power for supply into the accelerator cavity 18, and preferably excites a basic mode of the single resonator cavity 24 that can be coupled as an accelerator mode in the accelerator cavity 18. A 4-port directional coupler 20, comprising an HF side 32 with ports P1 and P4 and a cavity side 34 with the ports P2 and P3, is provided to split the HF energy into the two power couplers 26*a* and 26*b*. On the HF side 32, the HF source 14 and an HF load 16 which serves to absorb reflected HF power are connected. The directional coupler 20 is designed to split a power supplied at port P1 to the ports P2 and P3. Power reflected from port P2 or from port P3 is furthermore passed to port P4. The entire reflected energy is thus passed in the direction of the HF load 16, while an HF power of the HF source 14 is split symmetrically between the ports P2 and P3. Anon-reciprocal phase shifter 22 is provided in the waveguide 28 between the port P3 and the second power coupler 26*b*. The non-reciprocal phase shifter 22 causes a phase shift in the power flowing forward in the direction of the HF power coupler 26*b* in such a way that this power can be coupled into the accelerator cavity 18 with the correct phase relative to the HF power coupled in by the first power coupler 26*a*, in order to excite the basic acceleration mode. The magnitude of the forward phase shift is accordingly based on the length and the number of the cavities of the accelerator cavity 18. Power reflected from the second power coupler 26*b* is delayed in the return phase by the returning branch of the non-reciprocal phase shifter 22 in such a way that it can be superimposed on a reflected HF power of the first power coupler 26*a* in the directional coupler 20 with destructive interference. The entire reflected and superimposed power of the two HF branches is absorbed in the HF load 16. The HF source 14 is not subjected to reflected power, and can work with an optimised efficiency. The phase delay of the non-reciprocal phase shifter 22 in the forward branch and in the returning branch must be selected in such a way that an optimised power coupling, with the correct phase relative to the power coupled in by the first power coupler 26*a*, is achieved in the forward branch. The returning reflected HF energy is phase-delayed in such a way that it is superimposed on the reflected energy of the first power coupler 26*a* with destructive interference in the directional coupler 20. An optimum operation with a high efficiency of the HF power is thus achieved. The accelerated electron beam 60 is guided out of the resonator cavity 18 via a drift tube 64, and can be used for farther purposes, for example as a high-energy beam for the excitation of electromagnetic fields, as a therapy beam for cell irradiation, for basic scientific experiments or for other purposes.

FIG. 2 illustrates a particle accelerator 10, whose principles are the same as those of FIG. 1, in a second embodiment 102. In contrast to the embodiment according to FIG. 1, two non-reciprocal phase shifters 22*a* and 22*b* are provided on the cavity side 34 of the directional coupler 20 in both HF branches leading to the power coupler 26*a* and to the power coupler 26*b*. Each of the two phase shifters 22*a* and 22*b* comprise different phase delays in the forward and reverse directions, whose purpose is to couple in the coupled-in HF power in the correct phase and to correlate the reflected HF power of the two branches in such a that they are superimposed destructively in the directional coupler 20 and can be passed on to the HF load 16. This opens up the possibilities of being able to adjust the supplied. HF power in both HF branches, as well as die reflected HF power, over larger ranges than illustrated in the first exemplary embodiment 100 in FIG. 1, in order to achieve an optimum efficiency. The HF section of the particle accelerator 10 can be adapted individually to different accelerator cavities 18 thanks to the adjustability of the two non-reciprocal phase shifters 22*a* and 22*b*.

FIG. 3 illustrates a further exemplary embodiment 104 of a particle accelerator 10. It corresponds substantially to the embodiment of FIG. 1, but both an adjustable non-reciprocal phase shifter 30 and also an HF switching element 36 are provided in the HF branch 28 leading from the 4-port directional coupler 22 to the second power coupler 26*b*. A second HF coupling-in point of the resonator cavity 18 can be activated by means of the HF switching element 36, which can preferably be switched on or off electronically by a switching signal, such that the power of the particle beam 60 can be significantly increased. The preferably electronically adjustable non-reciprocal phase shifter 30 permits the phase offset of the forward wave as well as of the returning wave to be adjusted individually. The adjustability of the phase of the incoming wave permits a larger treasure of power control of the particle beam 60. The regulation of the returning HF wave accordingly permits a matching to the reflected wave of the first power coupler 26*a*, in order to operate the HF source 14 at optimised efficiency.

It is clear that frequency and phase detectors can be provided in the supplied HF branches 28, which output information about the phases of the forward and returning HF waves in the HF waveguides 28 when regulating, for example, the adjustable non-reciprocal phase shifter 30. A controller, not illustrated, enables the adjustment of the phase offset of the phase shifter 22, and permits control of the switching on or off of the HF switching element 36.

FIG. 4 illustrates a further embodiment 106 of a particle accelerator 10. The basic form of the embodiment 106 illustrated in FIG. 4 corresponds to that of the embodiment illustrated in FIG. 1. In addition, however, to a first and a second power coupler 26*a* and 26*b*, the particle accelerator 106 comprises a further power coupler 26*c*. The power coupler 26*c* couples HF power in a connecting segment 66 between a first section 18*a* and a second section 18*b* of a resonator cavity 18. As a result, HF power can be coupled in at three points of the cavity 18, and the HF power input can thus be significantly increased. To supply the three power couplers 26*a*, 26*b* and 26*c*, the HF power of the source 14 is split by the directional coupler 20*a* into two partial branches. The first partial branch supplies the power coupler 26*a* with about 50% of the supplied HF energy. The second partial branch is guided via a first non-reciprocal phase shifter 22*a* and to an HF side 32 of a second directional coupler 20*b*. The first non-reciprocal phase shifter 22*a* is configured to delay a reflected HF wave from the HF side 32 of the second directional coupler 20*b* in such a way that it can be superimposed on a reflected HF power of the first power coupler 26*a* in the first directional coupler 20*a* with destructive interference, and can be passed to the HF load 16*a*, A second HF load 16*b* is connected to the HF side 32 at the second directional coupler 20*b*. The third power coupler 26*c* is connected to the cavity side 34 of the second directional coupler 20*b* and, via a further non-reciprocal phase shifter 22*b*, to the second power converter 26*b*, each of which supplies about 25% of the HF power. The embodiment 106 thus constitutes a cascaded HF supply, where a further branch, comprising a second directional coupler 20*b* and a second phase shifter 22*b*, is connected via a first directional coupler 20*a* and a first phase shifter 22*a*. The second directional coupler 20*b* is connected on its HF side 32 to a second HF load 16*b*. As a result, reflected powers of the second and third power couplers 26*b* and 26*c* can thus be delayed with the correct phase by the second phase shifter 22*b* and guided to the second HF load 16*b*. The reflected HF power of the HF side 32 of the second directional coupler 20*b* is guided via the non-reciprocal phase shifter 22*a* to the cavity side 34 of the first directional coupler 20*a*. The reflected HF power can be superimposed on the HF power reflected from the first power coupler 26*a* in the first directional coupler 20*a*, and guided in turn into the first HF load 16*a*.

A modular structure is proposed in FIG. 4, to which further HF power couplers can be connected, so that a high HF power can be supplied into the accelerator cavity 18. According to the exemplary embodiment of FIG. 4, about 50% of the HF energy is coupled in at the first HF power coupler 28*a*, and about 25% of the HF energy at each of the further power couplers 28*b*, 28*c*.

In order for an HF energy of the same magnitude to be coupled in at all the coupling-in points, the number of power couplers 28 that should be provided is 2n. The exemplary embodiment of FIG. 5 thus shows a thither embodiment 108 of a particle accelerator 10 having an acceleration cavity 18 with three partial segments 18*a*, 18*b* and 18*c*. Four HF power couplers 28*a*, 28*b*, 28*c* and 28*d* are provided at the acceleration cavity 18, where about 25% of the energy of the HF source 14 is supplied into the cavity at each power coupler. Two supply networks are connected for this purpose on the cavity side 34 of the first directional coupler 20*a*, each of which comprise an input-side phase shifter 22*a*, 22*c*, followed by a directional coupler 20*b*, 20*c* with HF load 16*b*, 16*c*, and then a further phase shifter 22*b*, 22*d* in a branch to the HF power coupler 26*b*, 26*d*. As a result, the same amount of HF energy can be supplied via each power coupler 26, and the power can be adjusted over a wide range by a phase adjustment of the non-reciprocal phase shifter 22*a*.

Cascadable power stages can be connected by HF switching elements, where the power and the reflected energy of the HF wave can be adjusted over wide ranges by the provision of controllable non-reciprocal phase shifters. A compact embodiment of a particle accelerator, as can be employed in cancer therapy for the creation of gamma rays, can thus be provided. The bunched acceleration of the particles is achieved in that HF power of the HF source is distributed in equal amplitudes via a 3 dB coupler. The HF wave, can be supplied at the beginning of the accelerator structure, and can be supplied via a fixed phase shifter with the correct phase into a second coupling-in point. The returning wave of the second coupling-in point is shifted in phase in the non-reciprocal phase shifter in such a way that the superposition of the first wave in the 313 coupler diverts the reflected wave into the HF load. This permits the design of a modular and flexible HF supply section of an accelerator structure, and operation of the HF source with an optimised efficiency, so that a cavity with compact dimensions and low quality can be used to create a high electron beam power.

LIST OF REFERENCE NUMERALS

10 Particle accelerator
12 Particle source
14 HF source
16 HF load
18 Acceleration cavity
20 4-port directional coupler
22 Non-reciprocal phase shifter
24 Single resonator cavity
26 HF power coupler/HOM coupler
28 HF waveguide
30 Adjustable non-reciprocal phase shifter
32 HF side of the directional coupler
34 Cavity side of the directional coupler
36 HF switching element
60 Particle beam
62 Focusing segment
64 Drift tube
66 Connecting segment/drift tube
100 Particle accelerator, first embodiment
102 Particle accelerator, second embodiment
104 Particle accelerator, third embodiment
106 Particle accelerator, fourth embodiment
108 Particle accelerator, fifth embodiment

The invention claimed is:

1. Particle accelerator, flit creation of a bunched particle beam, comprising an HF source and a directional coupler for splitting an HF power of the HF source on art HF side into at least a first and a second HF power coupler of a cavity side for coupling HF power into at least one accelerator cavity, wherein a non-reciprocal phase shifter is inserted on, the cavity side between the directional coupler and the second HF power coupler, and an HF load is connected on the HF side to the directional coupler, where the non-reciprocal phase shifter is configured to pass a reflected HF wave of the second HF power coupler with phase delay in the direction of the directional coupler in such a way that a destructive interference of the reflected HF waves of the first and second power couplers occurs in the directional coupler in the direction of the HF source on the HF side.

2. Particle accelerator according to claim 1, wherein the directional coupler is a 4-port directional coupler, in particular a 3 dB directional coupler.

3. Particle accelerator according to claim 1, wherein the non-reciprocal phase shifter is configured to pass through an adjustably changeable phase delay of the reflected HF wave.

4. Particle accelerator according to claim 1, wherein at least a second, non-reciprocal phase shifter is comprised, which is inserted on the cavity side between the directional coupler and an HF power coupler.

5. Particle accelerator according to claim 1, wherein at least a third HF power coupler (26*c*) is comprised, which is connected via at least one second directional coupler to the cavity side of the first directional coupler, and which couples HE power into the accelerator cavity at a further coupling-in point.

6. Particle accelerator according to claim 5, wherein a second HF load is connected to an HF side of the second directional coupler.

7. Particle accelerator according to claim 5, wherein a further non-reciprocal phase shifter is inserted between the first directional coupler and the second directional coupler.

8. Particle accelerator according to claim 1, wherein an HF switching element is comprised, which can disconnect the second HF power coupler from the directional coupler.

9. Method for the operation of a particle accelerator for creation of a bunched particle beam, the particle accelerator comprising HF source and a directional coupler for splitting an HF power of the HF source on an HF side into at least a first and a second HF power coupler of a cavity side for coupling HF power into at least one accelerator cavity, wherein a non-reciprocal phase shifter is inserted on the cavity side between the directional coupler and the second HF power coupler, and an HF load is connected on the HF side to the directional coupler, where the non-reciprocal phase shifter is configured to pass a reflected HF wave of the second HF power coupler with phase delay in the direction of the directional coupler in such a way that a destructive interference of the reflected HF waves of the first and second power couplers occurs in the directional coupler in the direction of the HF source on the HF side, the method comprising adjusting the phase delay of the non-reciprocal phase shifter such that a reflected HF wave of the second HF power coupler is superimposed on a reflected HF wave of the first power coupler in the directional coupler in such a way that a destructive interference of the returning HF waves on the ELF side results in the direction of the HF source.

10. Method for the operation of a particle accelerator according to claim 9, wherein the phase delay of the non-reciprocal phase shifter is controlled.

11. Method according to claim 10, wherein control of the phase delay of the non-reciprocal phase shifter regulates an HF power input into the accelerator cavity.

* * * * *